US006860010B2

(12) United States Patent
Jones et al.

(10) Patent No.: US 6,860,010 B2
(45) Date of Patent: Mar. 1, 2005

(54) METHOD OF FORMING AN AUTOMOTIVE VALVE COVER WITH INTEGRAL POSITIVE CRANKCASE VENTILATION

(75) Inventors: Bart R. Jones, Midland, MI (US); Daryl J. Hertema, Midland, MI (US); Ravi Ramanathan, Midland, MI (US); Sam L. Crabtree, Midland, MI (US)

(73) Assignee: Dow Global Technologies, Inc., Midland, MI (US)

( * ) Notice: Subject to any disclaimer, the term of this patent is extended or adjusted under 35 U.S.C. 154(b) by 282 days.

(21) Appl. No.: 10/146,251

(22) Filed: May 15, 2002

(65) Prior Publication Data

US 2003/0214082 A1 Nov. 20, 2003

(51) Int. Cl.[7] ..... B21K 3/00; F01M 9/10

(52) U.S. Cl. ..... 29/888.01; 29/527.1; 29/458; 29/525.13; 123/90.38; 264/523

(58) Field of Search ..... 29/888.08, 527.1, 29/458, 525.01, 525.13; 264/523; 123/90.38

(56) References Cited

U.S. PATENT DOCUMENTS

| | | | | |
|---|---|---|---|---|
| 3,934,623 A | | 1/1976 | Hays | |
| 4,509,468 A | * | 4/1985 | Cockburn et al. | 123/90.38 |
| 4,522,165 A | * | 6/1985 | Ogawa | 123/195 C |
| 4,602,595 A | * | 7/1986 | Aoki et al. | 123/41.86 |
| 4,723,529 A | * | 2/1988 | Yokoi et al. | 123/573 |
| 4,993,375 A | * | 2/1991 | Akihiko | 123/90.38 |
| 5,129,371 A | * | 7/1992 | Rosalik, Jr. | 123/90.38 |
| 5,285,754 A | | 2/1994 | Bell | |
| 5,298,587 A | | 3/1994 | Hu et al. | |
| 5,320,875 A | | 6/1994 | Hu et al. | |
| 5,323,745 A | | 6/1994 | Sato et al. | |
| 5,433,786 A | | 7/1995 | Hu et al. | |
| 5,494,712 A | | 2/1996 | Hu et al. | |
| 5,636,607 A | | 6/1997 | Sattler et al. | |
| 5,837,958 A | | 11/1998 | Fornsel | |
| 6,085,709 A | * | 7/2000 | Freese, V | 123/90.38 |
| 6,092,498 A | | 7/2000 | Lohr et al. | |
| 6,095,105 A | | 8/2000 | Lohr et al. | |
| 6,189,521 B1 | | 2/2001 | Hancock | |
| 6,234,154 B1 | | 5/2001 | Spix | |
| 6,293,268 B1 | | 9/2001 | Mammarella | |
| 2002/0112684 A1 | * | 8/2002 | Jones et al. | 123/90.38 |

FOREIGN PATENT DOCUMENTS

| | | |
|---|---|---|
| DE | 35 12713 A1 | 10/1986 |
| JP | 62157267 | 7/1987 |
| WO | WO 01/44311 A1 | 6/2001 |

OTHER PUBLICATIONS

International Search Report dated Aug. 29, 2003 (1062–015WO).

U.S. Appl. No. 09/466,321 entitled "Amine Organoborane Complex Polymerization Initiators and Polymerizable Compositions".

U.S. Appl. No. 09/766,792 entitled "Improved Seating System and Method for Making the Same".

U.S. Appl. No. 09/825,721 entitled "Adhesively Bonded Radiator Assembly" filed Apr. 4, 2001.

U.S. Appl. No. 09/921,636 entitled "Adhesively Bonded Oil Pan Assembly" filed Aug. 3, 2001.

U.S. Appl. No. 09/922,030 entitled "Adhesively Bonded Water Conductor Assembly" filed Aug. 3, 2001.

U.S. Appl. No. 10/051,417 entitled "Adhesively Bonded Valve Cover Cylinder Head Assembly".

* cited by examiner

*Primary Examiner*—Marc Jimenez
(74) *Attorney, Agent, or Firm*—Dobrusin & Thennisch PC

(57) ABSTRACT

A method of forming a valve cover suitable for attachment to an engine head is disclosed. The valve cover is molded from a plastic material to include at least one structure of a positive crankcase ventilation (PCV) system. Additionally, the design of the valve cover includes various advantages including, for example, structural integrity, ease of installation or the like.

21 Claims, 4 Drawing Sheets

METHOD OF FORMING AN AUTOMOTIVE VALVE COVER WITH INTEGRAL POSITIVE CRANKCASE VENTILATION

TECHNICAL FIELD

The present invention relates to a valve cover suitable for attachment to an engine head in an automotive vehicle. More specifically, the invention relates to a plastic valve cover having integrated positive crankcase ventilation (PCV).

BACKGROUND OF THE INVENTION

Engine heads of automotive vehicles generally include valve covers. Portions of positive crankcase ventilation systems may be integrated into these valve covers for assisting in removing vapors from the vehicle engine and preventing vapors from being expelled directly into the environment. Fabrication of such valve covers generally requires consideration of various different conditions to which the valve covers will be exposed as part of the engine of an automotive vehicle, such as vibration, thermal cycling, space considerations and the like.

To help reduce part count, it would be attractive to integrate a positive crankcase ventilation (PCV) system into a valve cover. Efforts to do so in the past generally have involved mechanical attachment of parts, frequently of dissimilar materials. Such assembly requires many parts and can be labor intensive. Accordingly, there is a need to provide a method of manufacture and resulting valve cover having an integrated PCV, pursuant to which fewer components and less labor are required for the formation of the valve cover with PCV. There is a further need for such a valve cover to withstand the various conditions to which the valve cover may be exposed.

SUMMARY OF THE INVENTION

The present invention meets the above needs and others by providing a valve cover with an integrated PCV system and a method of manufacturing the valve cover. The valve cover preferably includes a single, substantially continuous body portion with a plurality of walls defining at least one internal cavity and at least one tubular structure. The tubular structure provides a pathway for positive crankcase ventilation. For forming the valve cover, molding techniques (e.g., blow molding) may be used. Moreover, the valve cover may include one or more additional features such as insulating material, rigidified portions or the like.

DETAILED DESCRIPTION OF THE PREFERRED EMBODIMENT

Figure 1:
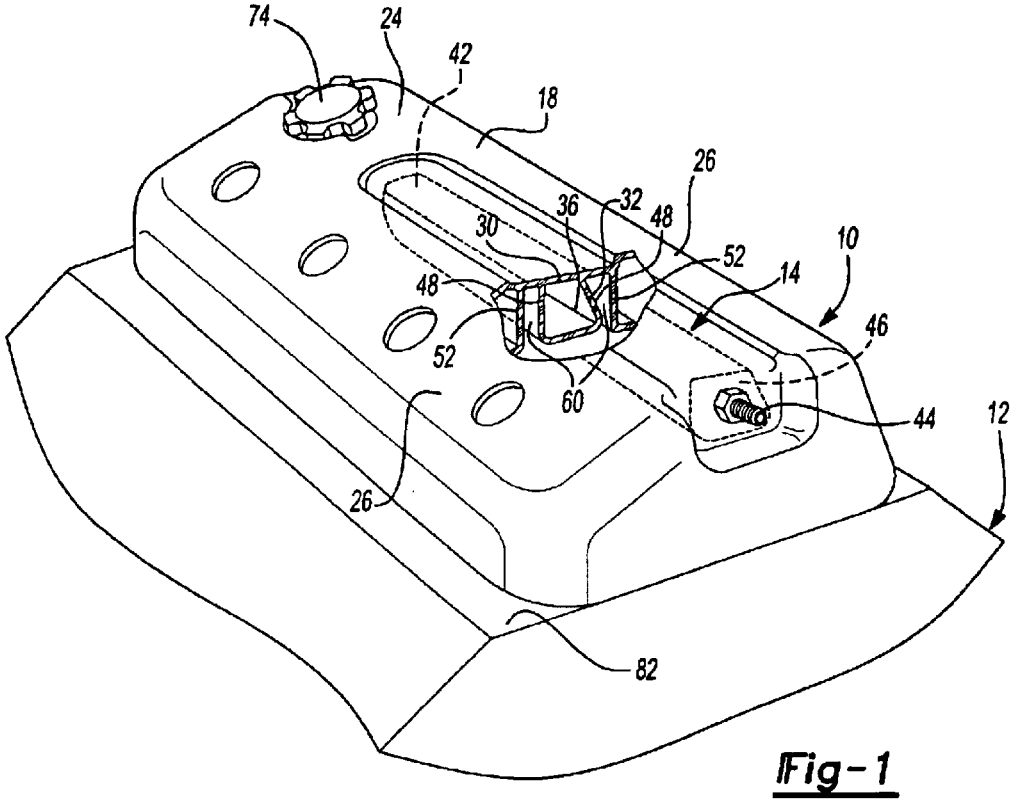
FIG. 1 is a perspective view of a valve cover for a cylinder head of an automotive vehicle.

Referring to FIGS. 1–4, the present invention is generally premised upon the manufacture of an engine valve cover 10 suitable for attachment to an engine component 12 of an automotive vehicle wherein at least a portion 14 of a positive crankcase ventilation (PCV) system is integrated into the cover 10. Contemplated within the invention is a valve cover, which includes one or more (more preferably two or more, still more preferably three or more, even still more preferably four or more, and even still more preferably all) of the following attributes:

a) the valve cover is formed substantially entirely of a thermoplastic material b) the valve cover includes at least one pathway suitable for assisting in the PCV function;

c) the valve cover is molded and more preferably is blow molded;

d) the valve cover is structurally designed with one or more locally rigidified portions (e.g., blow-molded "tack-offs"); or e) the valve cover is adapted to be assembled to an engine with an adhesive.

As used herein, the phrase "wall stock thickness" or "wall thickness" shall refer to the dimension between two surfaces of a single wall of a plastic material. Moreover, the phrase "part section thickness" or "section thickness" shall refer to the dimension between the outside walls of a two walled plastic part if cut by an intersecting plane. The phrase "tack-off" shall refer to a location where a first and second wall of a plastic blow molded component are joined to effectively create a beam structural section to add stiffness to the part. The structure defined by such a tack off may include a plurality of walls that are spaced apart to effectively define a beam structure; it may include a plurality of walls in contact with each other, or it may include a single wall or rib (the latter structures being formed in accordance with art disclosed techniques, such as employing one or a plurality of movable inserts in the tooling during forming).

The present invention contemplates techniques and methods for the optimization of one or more of material selection, wall thickness, section thickness, and tack-off design pattern for realizing a valve cover with the desired amount of strength, durability and the like for allowing the cover to endure the various conditions such as vibration, impacts, thermal cycles and the like typically experienced within the engine of an automotive vehicle. The skilled artisan will recognize, however, that from application to application, design requirements will vary, and therefore a reasonable amount of experimentation may be needed to adapt the various teachings to a unique intended environment. By way of example, part size, engine type and engine size may affect final design. It is believed that the use of conventional computer aided engineering (CAE) techniques in combination with the present teachings will yield satisfactory results, which can be improved as desired with conventional techniques.

Preferred Structural Configurations

Generally speaking, the valve cover of the present invention includes one or more walls defining one or more cavities within the valve cover. Preferably, the one or more cavities are substantially or entirely enclosed within the valve cover. It is preferable for the valve cover to include a suitable insulation material within the one or more cavities for absorbing sound, vibration or both within an automotive vehicle. The valve cover also includes at least one structure defining at least a portion of a PCV system. Preferably, the structure defines a pathway of a PCV system for guiding fluids therethrough.

Referring to FIGS. 1–4, there is illustrated one exemplary preferred embodiment of a valve cover 10 formed according to the present invention. The exemplary cover 10 has a length L and a width W. The cover 10 is formed of a single substantially continuous body portion 18, which includes a plurality of spaced apart walls defining a substantially continuous inner cavity 20, adapted for providing thermal insulation, noise insulation, vibration dampening or some other beneficial function to the cover. The body portion 18 includes a central portion 24 and transverse portions 26 that extend away from the central portion 24. Preferably, the transverse portions 26 are generally parallel to each other, but they need not be. One or both of the transverse portions 26 includes a pair of generally opposing walls 28, which though shown as spaced apart, may be collapsed upon each other (or one of which may even be omitted entirely), thereby defining a section thickness with a portion of the cavity 20 therebetween. The section thickness may vary across the width or remain substantially constant across the width. Moreover, the section thickness of one transverse portion 26 may vary, with the other having a substantially constant section thickness.

Figure 3:
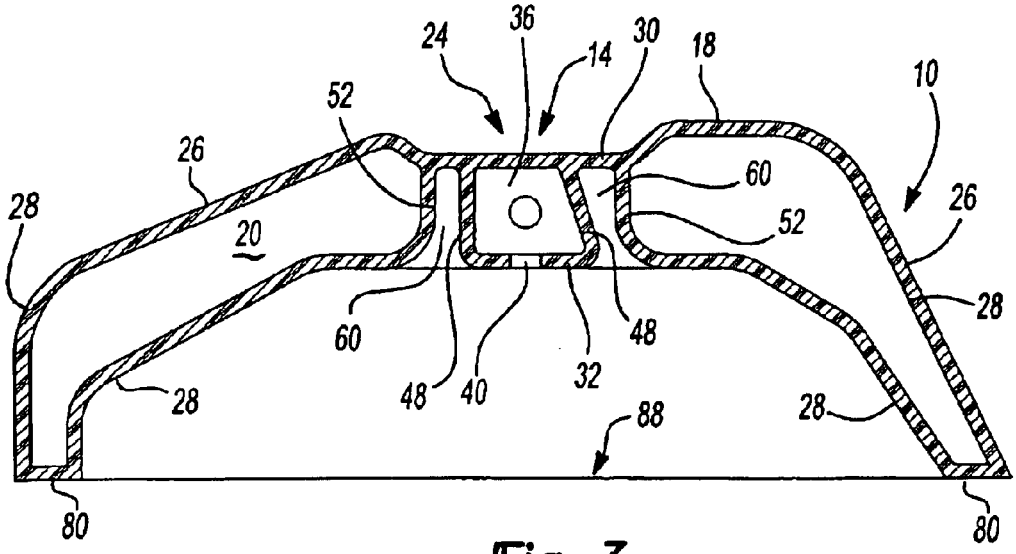
FIG. 3 is a sectional view of the valve cover of FIG. 2 taken along line 3—3.
Figure 4:
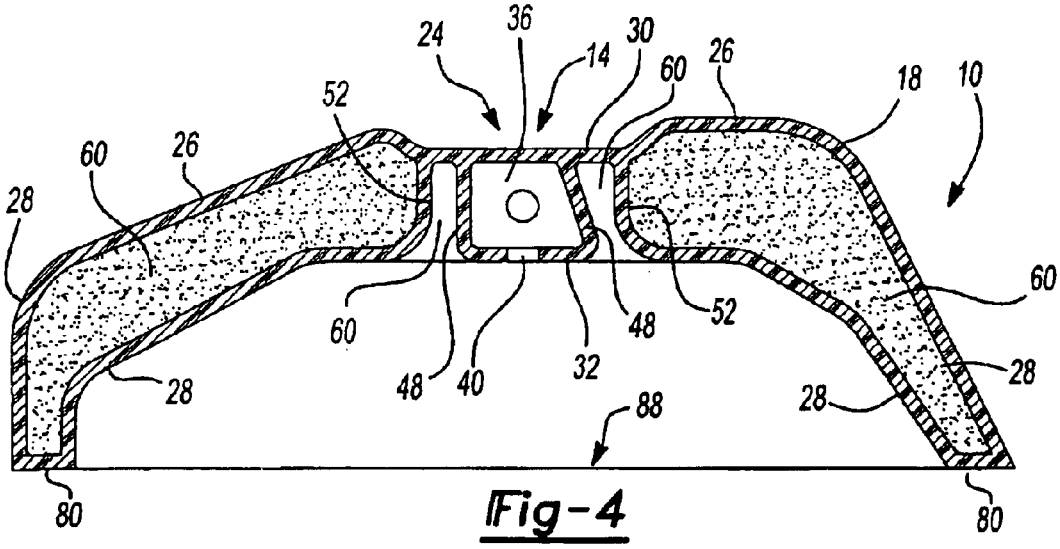
FIG. 4 is substantially identical to FIG. 3, however, FIG. 4 additionally illustrates absorption material disposed in the cover.

Shown in FIGS. 3 and 4, disposed between the transverse portions 26 is a web 30 integrally connecting the transverse portions 26 and a tubular structure 32, adapted for providing a PCV channel. More particularly, the tubular structure 32 is adapted for providing a substantially enclosed pathway or tunnel 36 (which may have cross-sections of a variety of shapes such as circular, square, rectangular elliptical, or otherwise shaped) through which fluids including vapors from within the engine head 12 may flow. The tubular structure 32 may be substantially straight, serpentine, contoured or otherwise shaped. In the example shown, a through-hole 40 is provided (e.g., by boring, by molding about a suitable stud in a mold or otherwise) at one end 42 of the tubular structure 32 and a valve 44 is provided at an opposite end 46 of the tubular structure 32. In operation, the valve 44 is preferably attached to a source of vacuum pressure for aspirating fluid (e.g., air and harmful vapors) through the through-hole 40, into the tunnel 36 and out through the valve 44. The tunnel 36 may have incorporated therein one or more structures, such as walls, baffles, louvers, fillers, screens or the like for affecting fluid flow within the tunnel. Additionally, the valve cover 10 may include one or more structures such as partial covers, hoses, tubes or the like for assisting in controlling fluid flow through the through-hole 40.

The present invention contemplates that in instances where multiple spaced wall portions are employed, optionally the overall body of the valve cover is reinforced by an intermediate reinforcing structure or member. The intermediate reinforcing structure may be any suitable structure for imparting additional rigidity, toughness or impact resistance to an overall valve cover. In the exemplary embodiment, the tubular structure 32 includes walls 48 that are spaced apart from wall portions 52 of the transverse portions 26. Cooperatively, the walls 48 of the tubular structure 32, the wall portions 52 of the extended members 26 and portions of the web 30 define tack-offs 60 within the cover 10 for imparting structural integrity to the cover 10.

In one preferred embodiment, one or more reinforcing members are integrally formed on the valve cover during the molding process. By way of illustration, and without intending to be limited thereby, in a preferred embodiment, a valve cover is fabricated by blow molding, pursuant to which a parison is placed in a cavity of a first tool adapted for defining the shape of a valve cover. The parison is heated to induce plasticity and a gas is injected into the parison to cause expansion of the parison within the tool cavity and the formation of generally opposing spaced apart first and second wall portions. At or after the expansion occurs and while the material remains in its plastic state, the first or optionally a second tool is brought into contact with one or both of the walls and deforms each contacted wall in the direction of the opposing wall. In one embodiment, the opposing walls remain spaced from each other. In a more preferred embodiment, the walls are brought into contact with each other and remain in contact by this deformation step, thereby forming a tack-off. The resulting space between wall portions defining a tack off may be as low as zero mm. It is also possible to accomplish a similar type of structure by forming two independent walls and then joining them with an intermediate rib structure.

Figure 2:
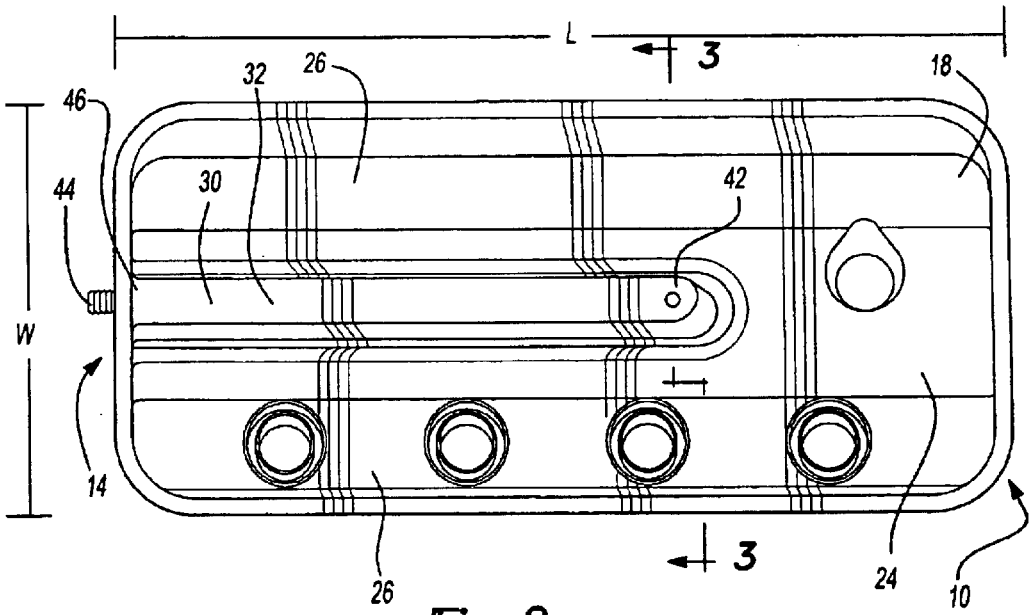
FIG. 2 is a top view of the valve cover of FIG. 1.

As stated, the valve cover may include a suitable material for noise reduction, thermal insulation or vibration dampening. Preferably, the material is disposed at least partially or fully within the one or more cavities within the valve cover. Suitable materials may include, for example, solid or foamed plastics or composites. The material may partially fill or substantially entirely fill the one or more cavities of the cover. Referring to FIG. 4, the valve cover 10 of FIGS. 1–3 is shown with a material 60 substantially filling the entire cavity defined between opposing walls 28 of the transverse portions 26 of the cover 10. Preferably, the material 60 is an expanded or foamed material that is initially positioned within the cavity 20 in a non-expanded state and is subsequently triggered to expand to an expanded state. Such materials, may be triggered by heat pressure, moisture or the like. One exemplary foam suitable for placement in the valve cover 10 is a polyurethane foam, one example of which is sold under the tradename BETAFOAM™ commercially available from The Dow Chemical Company.

Figure 5:
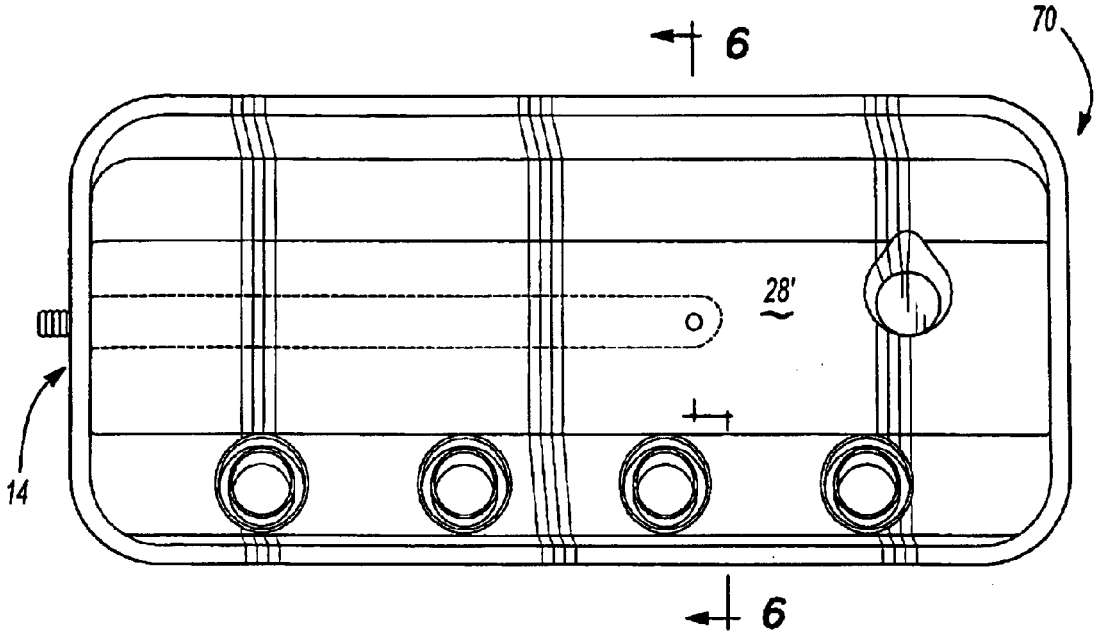
FIG. 5 is a top view of an alternative valve cover.
Figure 6:
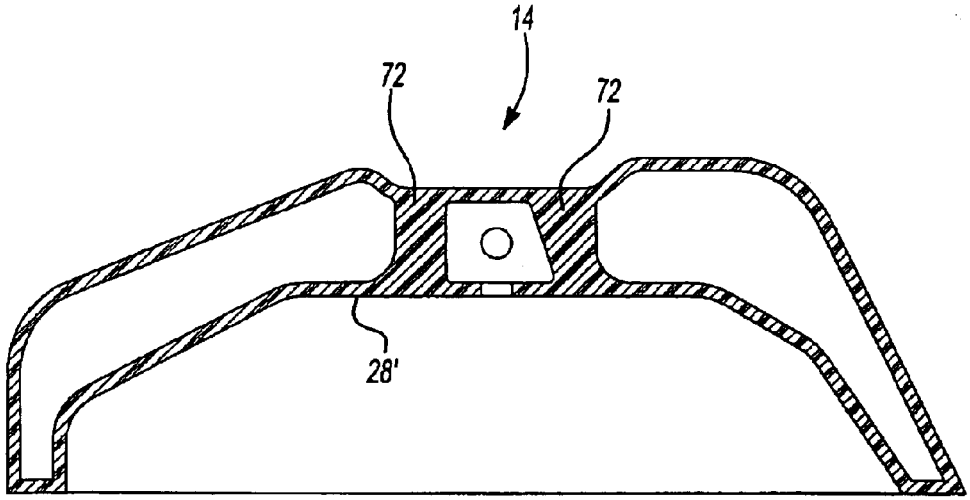
FIG. 6 is a sectional view of the valve cover of FIG. 5 taken along line 6—6.

The skilled artisan will recognize that various modifications may be made to the structural configuration of the valve cover 10 of FIGS. 1–3 without departing from the scope of the present invention. As an example and referring to FIGS. 5 and 6, there is illustrated an alternative valve cover 70 substantially identical to the valve cover 10 of FIGS. 1–4 with the exception that the central portion 24 has been filled in to form substantially solid intermediate portions 72 of the valve cover 70 on opposing side of the tubular structure 14. In one embodiment, the solid intermediate portions 72 are approximately 40 to 50 millimeters thick and act as reinforcement members for the valve cover 70. Accordingly, one alternative embodiment contemplates a substantially continuous (except for any opening to the tubular structure 14) wall 28'. It is further contemplated that the valve cover 10 may include additional structures or members, which may be integral or detachable such as a removable oil cap 74 (see FIG. 1).

In other alternative embodiments, it is contemplated that other portions of the valve cover 10 may function as part of a PCV system. For example, and without limitation, the inner cavity 20 or portions thereof may be adapted to function as part of a PCV system by itself or in conjunction with the tubular structure 32. Alternatively, the inner cavity 20 may be adapted to function as part of a PCV system while the tubular structure 32 may be filled with foam.

Additionally, a filtering system may be integrated into the valve cover for recovery of oil or other materials.

Figure 7:
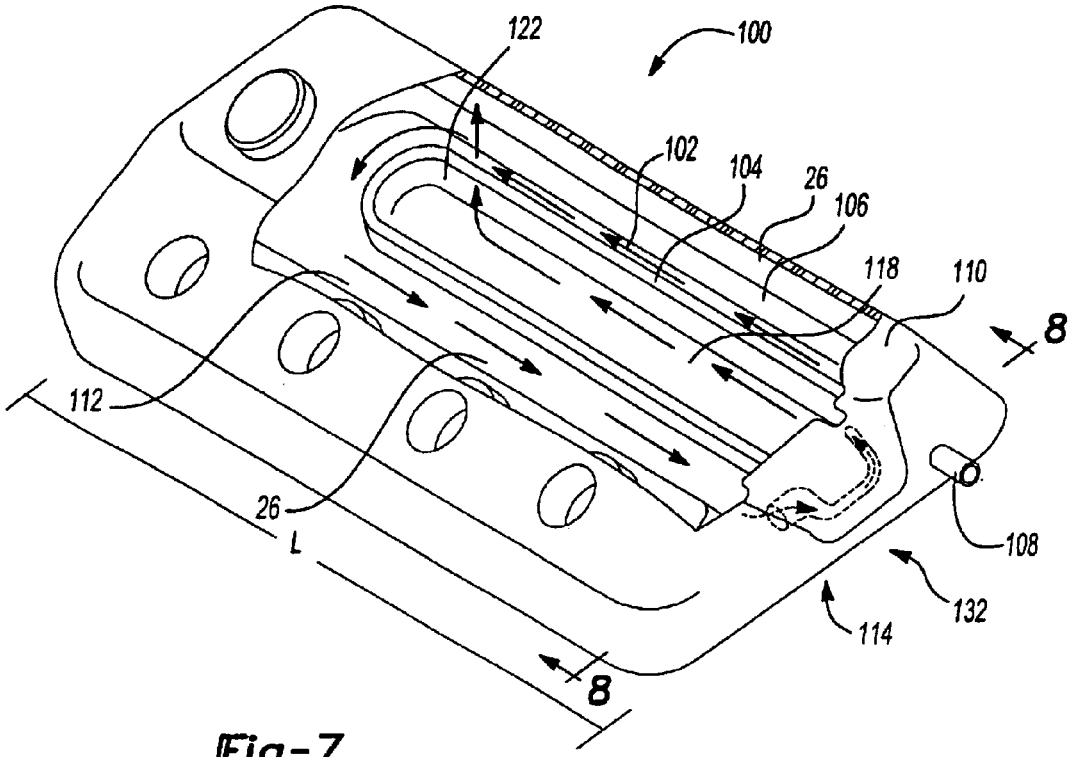
FIG. 7 is a perspective cut-away view of an alternative embodiment of a valve cover for a cylinder head of an automotive vehicle.
Figure 8:
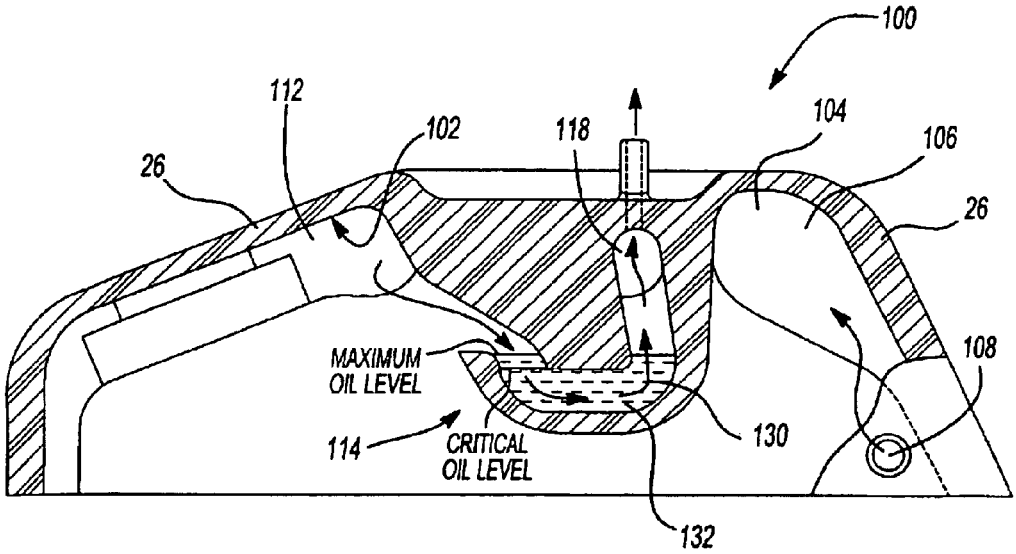
FIG. 8 is a sectional view of the valve cover of FIG. 7 taken along line 8—8.

Referring to FIGS. 7 and 8, there is illustrated another exemplary alternative embodiment of a valve cover 100 (e.g. a blow molded plastic cover) formed according to the present invention. The valve cover 100, the PCV system or both include an alternative tubular structure 102 (e.g. a serpentine configuration) defining an alternative tunnel 104 extending through the cover 100. In the exemplary embodiment shown, the tunnel 104 includes a first portion 106, which extends from one or more suitable inlets 108 (e.g., including a make-up air port, or optionally defining an air inlet/oil drain), preferably at an end portion 110 of the valve cover 100, along a substantial portion of the length (L) and through one of the transverse portions 26 of the valve cover 100. Thereafter, the tunnel 104 turns about 180 degrees and a second portion 112 of the tunnel 104 extends through the opposite transverse portion 26 along the length (L) of the valve cover 100 and back to a filtering system 114 at the original end 110 of the cover 100. The tunnel 104 again turns about 180 degrees arid a third portion 118 of the tunnel 104 extends through a central region of the cover 100, again along the length (L) of the cover 100 to a port portion 122 (e.g. an air exit to an intake manifold) suitably formed in the cover. One or more inlet/outlet ports may be formed elsewhere along the cover 100 (e.g. adjacent the J-shaped portion 132).

The filtering system 114 is an oil filtering system (e.g. an oil pool "trap") for recycling oil back to the engine of the vehicle. The system 114 includes an oil reservoir 130, which has been formed in and defined by a portion 132 of the tunnel 104 that is vertically below the remainder of the tunnel 104. In the embodiment shown, the portion 132 of the tunnel 104 is substantially J-shaped. It will be appreciated that the arrows denoting path in FIGS. 7 and 8 are illustrative and not intended as limiting. A number of different paths are possible.

In operation, fluid, including vapors and oil particles, enters the inlet 108 and travels through the first portion 106 and the second portion 112 of the tunnel 104. As can be seen, the first and second portions 106, 112 provide a relatively large volume and length for the fluid to travel. Advantageously, the length and volume of the portions 106, 112 allow the fluid to travel at a lower velocity over a greater period of time such that a substantial portion of the oil particles in the fluid are removed. Once through the first and second portions 106, 112, the fluid passes through or by the oil reservoir 130 of the filtering system 114. Preferably, oil of the oil reservoir 130 substantially fills the entire portion 132 of the tunnel 104 such that fluid is forced to pass directly through the oil in the reservoir 130. As the fluid passes through the oil, particles of oil remaining in the fluid are separated from the fluid into the oil of the reservoir 130. Preferably, as more and more oil is trapped in the reservoir 130, the oil will eventually drain back through the valve cover 100 to and through the inlet 108 to the engine (e.g., the engine head). Moreover, after the fluid travels through the oil, it can travel through the third portion 118 of the tunnel 104 to the outlet 122 where it may be guided to the air intake manifold of the vehicle or otherwise directed.

Preferred Materials

The materials selected for forming the walls of the valve cover of the present invention preferably exhibit an elastic modulus ranging from about 500 MPa to about 6000 MPa. The preferred yield strength of the material ranges from about 20 to about 200 MPa. Moreover, the ductility (as measured by percent elongation) of the material preferably ranges from about 20% to about 150%, and more preferably it is at least about 100%.

As will be appreciated, proper material selection will permit design of optimal wall thicknesses, part section thicknesses or both, for achieving the desired performance without substantially increasing vehicle weight or intruding into interior space availability. By way of example, it is desired for many applications that the maximum wall stock thickness will range up to about 6 mm or higher, more preferably it will range from about 1.5 mm to about 4.0 mm, and still more preferably, it will range from about 2.5 mm to about 3.5 mm. Likewise, the maximum section thickness will range up to about 60 mm, more preferably it will range from about 20 mm to about 40 mm, and still more preferably it will range from about 25 to about 35 mm.

For additional strength, and as best shown in FIGS. 3 and 4, the structure of the body portion 18 of the cover 10 is generally arc-shaped in cross-section, though other configurations are also possible. Remarkably, the arc-shaped cross-section allows the wall thicknesses of the body portion 18 to be thinner (e.g. as low as about 1.5 to about 2.5 millimeters thick) while maintaining sufficient structural integrity to function as a valve cover 10. Of course, the arc-shaped cross-section adds structural integrity to the cover 10 regardless of the thickness of the walls of the body portion 18.

Accordingly, in one preferred embodiment, the valve cover of the present invention preferably is made from a plastic material, and more preferably a thermoplastic material. In a particularly preferred embodiment, the valve cover is made from a high strength thermoplastic resins such as polystyrenes, nylons, olefins, polycarbonates or mixtures thereof. Alternatively, the valve cover is made from, for example, acrylonitrile butadiene styrene, polycarbonate/acrylonitrile butadiene styrene, polycarbonate, polyphenylene oxide/polystyrene, polybutylene terephthalate, polybutylene terephthalate/polycarbonate, polyamide, polyesters, polyethylene, and mixtures thereof. In one particularly preferred embodiment, the valve cover is formed of syndiotactic polystyrene, nylon 6,6 or a combination thereof.

In one preferred embodiment, the material is formed of blow-molded polypropylene. In another preferred embodiment, the valve cover is formed of blow-molded nylon such as VYDYNE™ commercially available from The Dow Chemical Company. In a highly preferred embodiment, the nylon or the polypropylene may be modified with up to about 10% by weight glass, more preferably about 10% to about 18% by weight glass and most preferably 18% to about 30% (e.g., 24%) by weight glass or more for increasing the impact resistance of the valve cover.

Valve Cover Attachment

In preferred embodiments, the valve cover is adapted to provide one or more mating surfaces, which may be adhesively or mechanically secured to the engine assembly or head. Preferably, the one or more mating surfaces of the valve cover correspond to and are configured to matingly fit with one or more mating surfaces of the engine head such that an adhesive, a gasket, or the like may be sandwiched between the surfaces of valve cover and the engine component to which it is attached.

The engine component is preferably formed of a metal (e.g., cast iron, steel, magnesium, aluminum, titanium or the like) and the valve cover is preferably formed of a plastic component. Thus, any adhesive used preferably has the capability to adhere to both materials.

Either or both of the component materials or the adhesive may be suitably treated (uniformly or locally) as desired to improve corrosion resistance, oxidation resistance, thermal resistance, or another characteristic of the final product. For instance, they might be admixed, impregnated or coated with suitable additives for achieving a desired property. In some instances, bond strengths might be enhanced by further contacting the adhesive with a suitable primer.

In one preferred embodiment, the mating surfaces may be locally treated with glass (e.g., glass strips or fibers) or glass filled materials to increase the ability of the adhesive to adhere to the mating surfaces. In such an embodiment, glass (e.g., as inserts) or glass filled material may be inserted into a mold at one or more locations that the mating surfaces are to form followed by molding (e.g., blow molding) the cover such that the glass is localized at the mating surfaces. Of course, this does not foreclose the possibility that various other portions of the valve cover or the entire valve cover may include glass in some form.

The adhesive is preferably provided over at least a portion of the surfaces to be joined, and preferably sufficiently about the periphery so that there are no appreciable gaps that result between joined components. In one embodiment, a bead of adhesive is placed (e.g., by pumping) on the respective mating surface of at least one of the components and the opposing mating surface is brought into contact with it. The assembly is then cured. In another embodiment, the adhesive is precoated (e.g., by spraying, dipping, brushing, swabbing, or the like) on one or both of the mating surfaces of the respective components and then the components are joined and cured. Any other suitable joining technique may likewise be employed. Preferably the amount of adhesive employed is sufficient to achieve the desired performance characteristics of the assembly. Such amount will vary from application to application.

In the exemplary embodiment of FIGS. 1–3, the valve cover 10 includes a mating surface 80 that is substantially planar and is configured to matingly fit with a mating surface 82 of the engine head 12 wherein the mating surface 82 of the engine head 12 is also substantially planar. Although the mating surfaces 80, 82 of the valve cover 10 and engine head 12 are shown as substantially planar, it shall be recognized that the mating surfaces 80, 82 may be configured to have various contours (e.g., stepped, corrugated, or the like) as well. In the embodiments shown, it is preferable for both the mating surface 82 of the engine head 12 and the mating surface 80 of the valve cover 10 to matingly extend substantially continuously about an opening 88 of the engine head 12. In such a configuration, the valve cover 10 and adhesive can form a substantially fluid tight seal about the opening 88. This function optionally allows the adhesive bead or film to replace gaskets as the primary sealing means. Further, though shown as having substantially planar opposing mating surfaces 80, 82, for forming a butt joint, such embodiment is not limiting. Other joints may be employed including lap joints, scarf joints, dove tail joints, tongue-in-groove joints, combinations of the above, or the like. It may also be possible to include suitable structure adapted for providing reinforcement of the joint, such as by tangs for snap fits, or otherwise. See, e.g., commonly owned co-pending applications Ser. No. 09/766,792 ("Adhesively Bonded Valve Cover Cylinder Head Assembly"), Ser. No. 09/922,030 ("Adhesively Bonded Water Conductor Assembly") (filed contemporaneously herewith), Ser. No. 09/921,636 ("Adhesively Bonded Oil Pan Assembly"), and Ser. No. 09/825,721 ("Adhesively Bonded Radiator Assembly"), hereby incorporated by reference.

Advantageously, joining the valve cover 10 to the engine head 12 with an adhesive may allow larger dimensional tolerances for mating surfaces that are being joined together as compared to situations wherein the valve cover 10 is attached to the engine head 12 without an adhesive (e.g., with fasteners only). In turn, processes such as blow molding, which can experience variable tolerances, may become more suitable for formation of the valve cover 10 where the valve cover 10 is going to be joined to the engine head 12 with an adhesive.

The adhesive may be applied to the valve cover 10 or engine head 12 in the immediate vicinity of the location where the components are to be joined with each other or it may be applied in a location remote from where or when the components are to be contacted. Remote as used herein refers can refer to one or both of time and location. In the embodiment where the adhesive is applied to one or more of the components remote from the place wherein the components are joined together, a cure-on-demand adhesive may be used.

The adhesive of the present invention is a structural adhesive and may optionally be a curable on demand material. Any adhesive that after cure can withstand the conditions of use of an engine (e.g., for an automotive vehicle) can be used. Preferably such adhesive does not decompose or delaminate at temperatures of up to about 138° C. (280° F.), more preferably up to about 143° C. (290° F.), even more preferably up to about 160° C. (320° F.) and most preferably up to about 191° C. (375° F.).

Furthermore, the adhesive is able to withstand exposure to hydrocarbon materials, calcium chloride, brake fluid, glycol coolants, windshield washer solvents and the like, at the above-mentioned temperatures and the pressures to which the internal combustion engine reaches internally. In an optional embodiment, the adhesive is able to bond to other engine components, which may be metallic, ceramic, composite, plastic, or the like. The adhesive used may be curable via a variety of known mechanisms including heat cure, infrared cure, ultraviolet cure, chemical cure, radio frequency cure, solvent loss and moisture cure.

In another embodiment, if the adhesive is a cure-on-demand adhesive, a separate operation may be employed to cause the adhesive to begin to cure. In one embodiment this is achieved by using an encapsulated curing agent which is ruptured during assembly. In another embodiment this is achieved by removing a protective coating to expose the adhesive to ambient conditions. Cure can be initiated by exposing the adhesive to heat, infrared or ultraviolet light sources, or to shearing forces and the like. Of course, it is always possible to employ an adhesive that does not have cure on demand capability.

While other adhesive families are contemplated as well (e.g., urethanes, acrylics, silanes, or the like), preferably the adhesive is a high temperature epoxy resin, a polyimide, a hybrid polyimide/epoxy resin adhesive or an epoxy novolac/nitrile rubber adhesive. Preferred adhesives are the high temperature epoxy resin adhesives. High temperature epoxy resin adhesive means an adhesive wherein the primary component is an epoxy resin which when cured can withstand exposure to the temperatures mentioned above without decomposing or delaminating from the substrate. Exemplary compositions for possible adhesives are disclosed in a patent application titled, "Amine Organoborane Complex Polymerization Initiators and Polymerizable Compositions", PCT Publication No. WO 01/44311 A1, U.S. Ser. No. 09/466,321, herein incorporated by reference.

In a particularly preferred embodiment, the adhesive is a mineral filled catalyzed adhesive that includes one or more regular or modified epoxy components, a suitable curing agent and a suitable thixotropic agent for maintaining a room temperature Brookfield viscosity (in uncured state) on the order of about 500 cps.

It should be recognized that the use of the term adhesive herein is not intended to foreclose primers or other bonding agents from the scope of the present invention.

Advantageously, the employment of a molded plastic valve cover enables the formation of intricately shaped structures. In this regard, valve cover can be molded or otherwise fabricated in or on one of its surfaces one or more components such as brackets, connectors, cable guides, hose guides, harnesses, clips or the like. Further, conduits, ports or other like passages can be cored or machined into a molded component to enable integration of multiple components into the valve cover.

As will be appreciated by the skilled artisan, among the many advantages of the present invention are that assemblies can be made that are substantially free of folding tangs, a sealing gasket, mechanical fasteners or all of these. However, the scope of the present invention does not foreclose the use of folding tangs, gaskets or fasteners. Indeed, it is contemplated that a gasket might be made from (e.g., by die cutting a gasket) the adhesive or incorporate as a component thereof (e.g. as an impregnant or coating), the adhesive of the present invention. The resulting structure seals much like a gasket would, but also exhibits the desirable mechanical characteristics of the structural adhesive. Additionally, mechanical attachments such as fasteners, weld (e.g., vibrations welds) may be used alone or in conjunction with the adhesive, a gasket, or both. Preferably, any adhesive used will allow fewer or different fasteners than might conventionally be used.

Of particular advantage to the present invention is that the surfaces, structures or both that are joined by the adhesive can be continuous (i.e., do not necessarily require holes for fasteners). The continuity of the surfaces assists in forming joints that are fluid (e.g., air or liquid) tight since the adhesive can be continuous between the surfaces.

In another embodiment the valve cover of the invention can include a coating or film on the exterior or interior which functions to improve the barrier properties of the valve cover to hydrocarbons. Such a coating of film can reduce the fugitive hydrocarbon emission from an automotive vehicle. Any coating or film which prevents the transmission of hydrocarbons through the assembly may be used. A preferred coating is a carbon-silica based plasma deposited coating as described in U.S. Pat. No. 5,298,587; U.S. Pat. No. 5,320,875; U.S. Pat. No. 5,433,786 and U.S. Pat. No. 5,494,712, all hereby incorporated herein by reference. In one preferred embodiment it is contemplated that one or more walls of may be blow molded in multiple layers wherein one of layers serve as a barrier to hydrocarbon emission. Alternatively, the valve cover may be blow molded to have a different composition at various locations of the cover. For example the portions of the valve cover most likely to contact hydrocarbons may be formed of a hydrocarbon barrier material while other portions are made of other materials. Advantageously, multiple layer walls may be molded in nearly any size, shape or length thereby offering the flexibility for the tubular structure and/or the PCV system to be formed of multiple layer walls in any of the aforementioned configurations.

Other surface treatments might also be employed such as plasma surface treatment pursuant to art disclosed teachings as found in U.S. Pat. No. 5,837,958, incorporated herein by reference.

In a particularly preferred embodiment, the resulting tensile strength of the adhesive of the joint in the assembly is at least about 4000 psi (28 MPa), more preferably at least about 6500 psi (45 MPa), and still more preferably at least about 9000 psi (62 MPa). Further preferably the strength of the joint is greater than the strength of at least one, and preferably more than one, of the individual molded components.

It should be understood that the invention is not limited to the exact embodiment or construction, which has been illustrated and described but that various changes may be made without departing from the spirit and scope of the invention.

What is claimed is:

1. A method of forming an integrated PCV with a plastic valve cover, the method comprising:

a) providing a polymeric material; and b) molding the polymeric material to form a single substantially continuous body portion for the valve cover wherein the valve cover includes:

i) a plurality of walls defining at least one internal cavity;

ii) a tubular structure defining a tunnel, the tubular structure including a through-hole at one end wherein the tubular structure is adapted for positive crankcase ventilation; and iii) at least one mating surface;

c) adhesively securing the valve cover to an engine head with an adhesive that includes epoxy wherein the adhesive is secured to the at least one mating surface of the cover and to a mating surface of the engine head and wherein the adhesive forms a joint with a tensile strength of at least about 6500 psi.

2. A method as in claim 1 wherein the at least one cavity is at least partially filled with an insulating material.

3. A method as in claim 1 wherein the valve cover includes at least one rigidified portion for imparting structural integrity to the valve cover.

4. A method as in claim 3 wherein the at least one rigidified portion of the valve cover is a tack-off.

5. A method as in claim 1 wherein the step of molding the polymeric material is accomplished by blow molding.

6. A method as in claim 5 further comprising securing the valve cover to the engine head with one or more fasteners.

7. A method as in claim 1 wherein the polymeric material used to form the body portion of the valve cover includes about 18% to about 30% glass and has yield strength in the range of about 20 MPa to about 200 MPa.

8. A method as in claim 1 wherein the valve cover includes a filtering system including an oil reservoir for removing oil from fluids during positive crankcase ventilation.

9. A method as in claim 8 wherein the tubular structure defines a serpentine portion having at least two opposing tube portions extending along a substantial portion of a length of the valve cover.

10. A method of forming an integrated PCV with a plastic valve cover, the method comprising:

a) providing filled thermoplastic material; and b) blow molding the filled thermoplastic material to form a single substantially continuous body portion for the valve cover wherein the valve cover includes:

i) a central portion;

ii) a pair of transverse portions extending away from the central portion, the transverse portions assisting in defining at least one internal cavity that is substantially enclosed by the valve cover; and iii) a tubular structure intermediate the transverse portions and defining a tunnel, the tubular structure including a through-hole at one end and a valve at an opposite end wherein the tubular structure is adapted for positive crankcase ventilation;

wherein the step of blow molding includes placement of a parison within a cavity of a first tool adapted for shaping the valve cover.

11. A method as in claim 10 wherein the at least one cavity is at least partially filled with an insulating material.

12. A method as in claim 10 wherein the valve cover includes at least one rigidified portion for imparting structural integrity to the valve cover.

13. A method as in claim 12 wherein the at least one rigidified portion of the valve cover includes a tack-off.

14. A method as in claim 10 further, comprising adhesively securing the valve cover to an engine head with an adhesive that includes epoxy.

15. A method as in claim 10 further comprising securing the valve cover to the engine head with one or more fasteners.

16. A method as in claim 10 wherein the nylon-based material used to form the body portion of the valve cover has yield strength in the range of about 20 MPa to about 200 MPa.

17. A method of forming an integrated PCV with a plastic valve cover, the method comprising:

a) providing a polyamide blend material; and b) blow molding the polyamide blend material to form a single substantially continuous body portion for the valve cover wherein the valve cover includes:

i) a central portion;

ii) a pair of transverse portions extending away from the central portion, the transverse portions assisting in defining at least one internal cavity that is substantially enclosed by the valve cover;

iii) a tubular structure intermediate the transverse portions and defining a tunnel, the tubular structure include a through-hole at one end and a valve at an opposite end wherein the tubular structure is adapted for positive crankcase ventilation; and iv) at least one surface configured for matingly contacting at least one surface of an engine head; and c) providing an insulating material in at least a portion of the at least one internal cavity of the valve cover; and d) adhesively securing the at least one surface of the body portion to the at least one surface of the engine head with an epoxy adhesive;

wherein the step of blow molding includes placement of a parison within a cavity of a first tool adapted for shaping the valve cover.

18. A method as in claim 17 wherein the valve cover includes at least one rigidified portion for imparting structural integrity to the valve cover.

19. A method as in claim 17 further comprising securing the valve cover to the engine head with one or more fasteners.

20. A method as in claim 17 wherein the blend material used to form the body portion of the valve cover has yield strength in the range of about 20 MPa to about 200 MPa.

21. A method as in claim 17 wherein the valve cover includes a filtering system including an oil reservoir for removing oil from fluids during positive crankcase ventilation wherein the oil reservoir is defined by a portion of the tunnel that is vertically below a remainder of the tunnel.

* * * * *